United States Patent [19]

Campbell

[11] 4,340,197

[45] Jul. 20, 1982

[54] DECOY MISSILE

[75] Inventor: George S. Campbell, Storrs, Conn.

[73] Assignee: The United States of America as represented by the Secretary of the Air Force, Washington, D.C.

[21] Appl. No.: 529,182

[22] Filed: Feb. 15, 1966

[51] Int. Cl.[3] ..... B64G 1/00

[52] U.S. Cl. ..... 244/3.1; 244/158 R; 244/160

[58] Field of Search ..... 343/18 E, 18 B; 102/92.4, 105, 49.4; 244/3.1, 158 R, 160

[56] References Cited

U.S. PATENT DOCUMENTS

| | | | |
|---|---|---|---|
| 603,466 | 5/1898 | Hammer | 102/399 |
| 2,957,417 | 10/1960 | Musgrave | 343/18 |
| 3,200,747 | 8/1965 | Sorenson et al. | 102/374 |
| 3,270,503 | 9/1966 | Meyer, Jr. | 60/35.6 |
| 3,290,681 | 12/1966 | Beteille | 343/18 |

*Primary Examiner*—Charles T. Jordan

*Attorney, Agent, or Firm*—Harry A. Herbert, Jr.; Arsen Tashjian

[57] ABSTRACT

A decoy missile having a high moment of inertia with a corresponding reduction of the natural oscillation frequency for simulating reentry of a ballistic nose cone into the earth's atmosphere. High density ballast material disposed in the forward section is in proportional relationship to similar ballast material in the base section such that the distance between the center of pressure and the center of gravity is equal to one-half the base diameter.

4 Claims, 2 Drawing Figures

DECOY MISSILE

Figure 1:
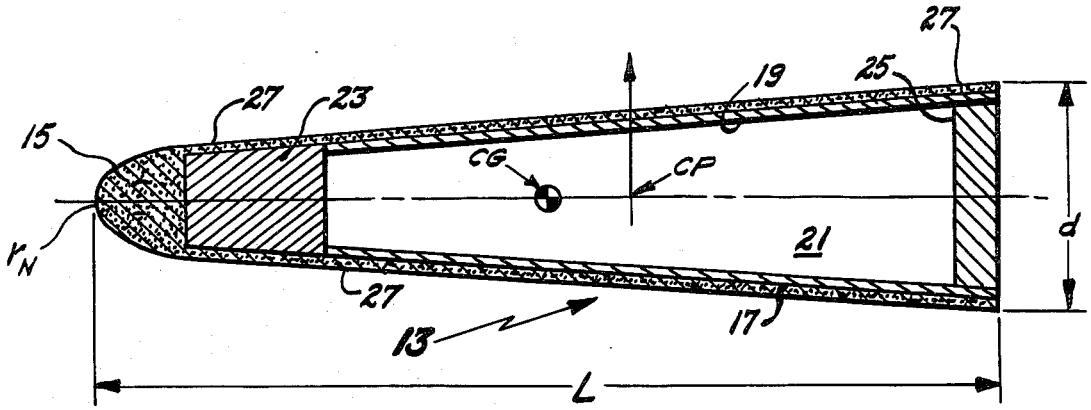

This invention relates to a decoy missile which simulates a larger ballistic missile reentering the earth's atmosphere from outer space. More particularly, the invention is concerned with matching the oscillation frequency and slow-down behavior of a ballistic missile during atmospheric reentry by using a lightweight decoy having high-density ballast at each end to provide a high moment of inertia and reduce the decoy's oscillation frequency.

Various means are available for detecting and destroying ballistic missiles during atmospheric reentry. These detecting means generally depend upon locating the reentering vehicle by observing the slow-down behavior and the oscillation frequency of the body as it enters the earth's atmosphere. The oscillation frequency is defined as the number of complete oscillations of a given system per unit time, commonly symbolized by v or f. The frequency is the reciprocal of the period which is the time for one complete oscillation. The angular frequency, symbolized by $\omega$, is used for greater convenience in manipulating trigonometric functions and has the unit radian per unit time which is equal to $2\pi\times$ frequency. The natural frequency of oscillation of the reentering missile falls within a known range depending on the weight and configuration of the body. Thus, anti-missile missiles can be designed and built which will acquire, track, and destroy a falling body in the atmosphere which has the oscillation frequency characteristics in the particular range covered.

The present invention discloses and describes a system whereby the oscillation frequency characteristics in a large missile such as an intercontinental ballistic missile can be simulated by a decoy which is many times smaller in size. By providing a decoy having configuration and weight distribution according to the present invention, the reentry characteristics of a full size missile can be duplicated thereby attracting any intercepting missiles which may be in the vicinity for defensive purposes and causing them to be deceived into tracking or following one or more of the decoys allowing the offensive missile to proceed toward its target. If, for example, one hundred decoys were launched so as to be in the reentry area when the missile is there, the possibility of an intercepting missile destroying the offensive missile is reduced to one in one hundred.

Accordingly, it is an object of the present invention to provide a decoy ballasting technique for constructing a decoy missile that will attract an intercepting missile and deceive its control system into following the decoy rather than an offensive missile which is in the area after reentering into the earth's atmosphere.

Another object of the present invention is to provide a decoy ballasting technique for producing a missile decoy that serves to protect a much larger ballistic missile against destruction by an anti-missile missile. This is accomplished by designing the decoy so that it has an oscillation frequency which matches that of the ballistic missile thereby deceiving the control system of the anti-missile missile into acquiring and destroying the decoy rather than the ballistic missile.

Still another object of the invention is to provide a system for increasing the effectiveness of a ballistic missile by giving it protection during reentry into the earth's atmosphere and preventing the missile from being destroyed before it reaches the target. A number of decoy missiles having certain characteristics of the ballistic missile are dispersed in the reentry area and operate to attract any defensive missile away from the ballistic missile thereby increasing its effectiveness.

A further object of the invention is to provide a decoy ballasting technique whereby the slow-down parameter and the oscillation frequency of a ballistic missile nose cone are matched with the decoy by considering three geometric parameters which include the nose radius, the length, and the diameter while at the same time providing the decoy with a realistic static margin to produce the proper characteristics for simulating the ballistic nose cone during reentry.

A still further object of the invention is to provide a lightweight decoy which accurately reproduces the oscillation frequency and slow-down behavior of a ballistic nose cone during reentry from outer space down to an altitude of 150,000 feet. Use of decoys of this type increases the difficulty of detecting and destroying the ballistic missile during atmospheric reentry.

These and other objects, features, and advantages will become more apparent after considering the following detailed description taken in conjunction with the annexed drawings and appended claims.

Figure 2:
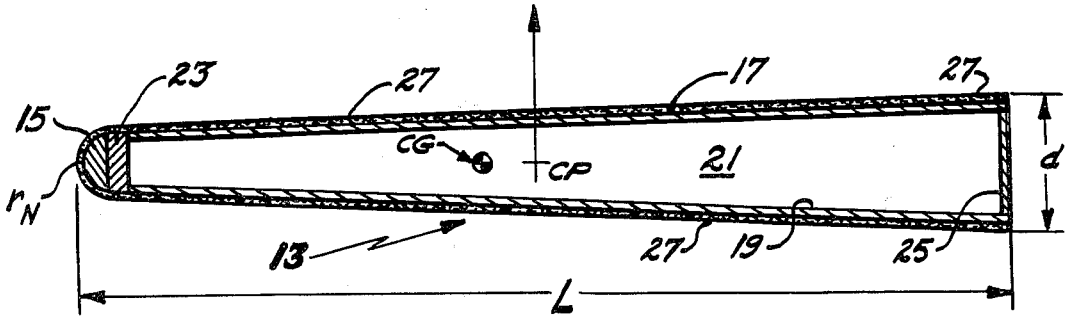

In the drawings wherein like reference characters refer to like parts in the views:

FIG. 1 is a view in cross section of a reentry decoy showing the parameters which are considered in matching the characteristics of a ballistic missile nose cone during reentry into the earth's atmosphere; and FIG. 2 is a view in cross section of a typical reentry decoy according to the invention showing the dimensional proportions required to simulate the reentry characteristics of an 8000 pound ballistic missile nose cone.

Referring now to the drawings, there is shown in FIG. 1 a cross sectional view of a decoy missile, generally designated by the character 13, having a rounded nose portion 15. A body portion extends rearwardly from said nose portion 15 and includes an outer wall 17 contoured to define the outer configuration of the body and an inner wall 19 which defines an elongated hollow chamber 21. At the rear of the nose portion 15 there is disposed a front ballast 23 which encloses the forward end of the hollow chamber 21. The rearward end of the hollow chamber 21 is enclosed by the rear ballast 25.

In the embodiment of the invention shown in FIG. 1, an ablation coating 27 is applied to the surface of the outer wall 17 of the body portion of the decoy missile. The rounded nose portion 15 is also provided with an ablation coating which removes itself during reentry and prevents damage to the other portions of the decoy 13.

The shape of the decoy missile 13 is determined by considering the size and shape of the nose cone of the full size missile which is being protected. In order to match the oscillation characteristics of the decoy with those of the nose cone, various parameters are considered. First, the reentry decoy should match the nose cone's slow-down parameter ($W/C_DA$) and oscillation frequency ($\omega$) and at the same time have a realistic static margin ($X_{sm}$). The procedure used to match these characteristics is illustrated by considering a nose cone having a frequency parameter $$\omega^2/q=0.05 \text{ ft/slug} \quad (1)$$

where:

$\omega$=oscillation frequency, radians/sec.

q=dynamic pressure $\rho V^2/2$, lb/ft.$^2$ $\rho$=air density, slugs/ft.$^3$

V=velocity of reentering object, ft/sec.

and by requiring the decoy to have a static margin equal to half its base diameter $$X_{sm}/d=0.5$$

where:

$X_{sm}$=static margin, distance between center of pressure and center of gravity, ft.

d=base diameter of reentering object, ft.

As seen in FIG. 1, three geometric parameters of the decoy remain to be specified: nose radius ($r_N$), length (L), and diameter (d) for the illustrated sphere-tipped cone. Thus, a large number of decoys can meet requirements illustrated by equations (1) and (2) and still meet a typical requirement for the slow-down parameter, such as $$300 \text{ lb/ft}^2 \leqq W/C_D A \leqq 1800 \text{ lb/ft}^2 \quad (3)$$

where:

W=weight of reentering object, lb.

$C_D$=drag coefficient, Drag/q A

A=base area of reentering object, ft.$^2$

A typical decoy of the type based on the above calculations is shown in FIG. 2 and has the following dimensional parameters:

$$L/d=8 \quad (r_N/d/2)=0.5$$

The weight breakdown, lbs.

| | |
|---|---|
| Nose cap | 0.9 |
| Magnesium skin | 10.8 |
| Ablation coating | 9.5 |
| Tungsten ballast | 10.4 |
| TOTAL | 31.6 |

Gage thickness, inches

Magnesium skin: 0.160

Ablation coating: 0.160

This decoy weighs approximately 32 pounds of which approximately 10 pounds is ballast and meets the requirements of equations (1) and (3) above. In addition, the decoy fits into a specified decoy launcher.

The illustrative design chosen in describing a working embodiment of the present invention actually meets the requirements for a decoy simulating an 8000 pound nose cone. This 32 pound decoy has the same oscillation frequency and exhibits the same slow-down behavior as the nose cone down to an altitude of 150,000 feet.

It can thus be seen that the timely launching of decoys of the type according to this invention can be highly effective in deceiving enemy interceptor missiles into tracking and destroying the decoys while allowing the ballistic missile nose cone to proceed toward its target. The use of decoys of this type are particularly effective during atmospheric reentry and greatly increase the difficulty of detecting and destroying the ballistic missile nose cone.

Although the invention has been illustrated and described in terms of preferred embodiments thereof, it will be apparent to one skilled in the art that certain changes, alterations, modifications, and substitutions can be made in the arrangement and location of the various elements without departing from the spirit and scope of the appended claims.

Having thus set forth and described the nature of my invention, what I claim is:

1. A decoy missile for simulating the characteristics of a ballistic missile nose cone during reentry into the earth's atmosphere, said decoy missile comprising a rounded nose portion having a hollow elongated body portion extending rearwardly therefrom, said decoy missile being symmetrical about its longitudinal axis, and means for reducing the natural oscillation frequency of said decoy, said means including a front ballast disposed in the forward section of said body portion immediately adjacent to said nose portion and a rear ballast disposed in the rearwardmost base section of said body portion, thereby providing a high moment of inertia and reducing the natural oscillation frequency of said decoy to match that of the ballistic missile nose cone.

2. The decoy missile defined in claim 1 wherein the oscillation frequency reducing means including said front and rear ballasts are in a predetermined proportional relationship to one another such that the relative positions of the center of pressure and the center of gravity of said decoy match the corresponding centers in the ballistic missile nose cone.

3. The decoy missile defined in claim 2 wherein the front and rear ballasts are positioned such that the distance between the center of pressure and center of gravity of said decoy is equal to one-half the base diameter thereof.

4. The decoy missile as defined in claim 2 wherein said front and rear ballasts comprise a high-density material to provide high moment of inertia and thereby reduce the oscillation frequency of said decoy to match the nose cone oscillations during reentry.

* * * * *